US007350868B2

(12) United States Patent
Lingegård et al.

(10) Patent No.: US 7,350,868 B2
(45) Date of Patent: Apr. 1, 2008

(54) CALF REST FOR PATIENT CHAIR

(75) Inventors: Hans Lingegård, Eslöv (SE); Bo Persson, Löddeköpinge (SE)

(73) Assignee: Arjo Hospital Equipment AB (SE)

( * ) Notice: Subject to any disclaimer, the term of this patent is extended or adjusted under 35 U.S.C. 154(b) by 0 days.

(21) Appl. No.: 10/555,584

(22) PCT Filed: May 4, 2004

(86) PCT No.: PCT/SE2004/000676

§ 371 (c)(1),
(2), (4) Date: Nov. 4, 2005

(87) PCT Pub. No.: WO2004/098480

PCT Pub. Date: Nov. 18, 2004

(65) Prior Publication Data

US 2006/0261660 A1 Nov. 23, 2006

(30) Foreign Application Priority Data

May 5, 2003 (SE) ..... 0301294

(51) Int. Cl.
*A47C 7/50* (2006.01)

(52) U.S. Cl. ..... 297/423.26; 297/423.29; 297/423.37

(58) Field of Classification Search ..... 297/423.26, 297/423.29, 423.37; 280/304.1
See application file for complete search history.

(56) References Cited

U.S. PATENT DOCUMENTS 1,279,120 A * 9/1918 Kellogg ..... 297/423.37 X
3,072,437 A 1/1963 Shea et al.
3,205,006 A * 9/1965 Mommsen ..... 297/423.26
3,212,817 A * 10/1965 Sully ..... 297/423.37
3,249,388 A * 5/1966 Jennings ..... 297/423.38
3,758,150 A * 9/1973 Williams ..... 297/423.26 X
4,176,879 A * 12/1979 Rodaway ..... 297/423.26
4,565,385 A 1/1986 Morford
4,887,826 A * 12/1989 Kantner ..... 297/423.26
5,522,644 A * 6/1996 Peek ..... 297/423.26

FOREIGN PATENT DOCUMENTS

GB 1 258 251 12/1971

* cited by examiner

*Primary Examiner*—Anthony D. Barfield
(74) *Attorney, Agent, or Firm*—Craig A. Fieschko, Esq.; DeWitt Ross & Stevens S.C.

(57) ABSTRACT

A calf rest is provided for a patient chair. The calf rest may comprise a plate-shaped calf rest pad and a mounting is be mounted on the patient chair by means of a joint arrangement. The joint arrangement may be designed so that the calf rest pad is movable between an inactive moved-away end position, in which the extent of the calf rest pad is substantially parallel to one side of the patient chair and the calf rest pad can be positioned close to the patient chair, and a second active end position, where the calf rest pad is capable of supporting the patient's legs when extended, outwards away from the patient chair.

22 Claims, 4 Drawing Sheets

CALF REST FOR PATIENT CHAIR

This application is a national stage filing under 35 U.S.C. § 371 of International Application No. PCT/SE2004/000676, filed on May 4, 2004, which claims priority from Swedish Application No. 0301294-5, filed on May 5, 2003.

FIELD OF THE INVENTION

The present invention relates generally to a calf rest for patient chairs of the type intended for washing, showering, dressing, undressing, and wheelchairs and the like which are used in nursing and home care, and in rehabilitation, etc.

PRIOR-ART TECHNIQUE

Many different types of patient chairs are known. Some of them are commonly mechanical, others are fitted in a complicated way with electronics for raising and lowering the seat, inclination backwards, and inclination of leg rest. Some of them have the convenience of the nursing staff in view while others are more concentrated on the patient's convenience. Sometimes these kinds of convenience seem to be incompatible, especially in mechanical patient chairs. Many patients are incapable of communicating their needs or wishes or discomfort to their carers.

One component of patient chairs which has not yet achieved a satisfactory function and handleability, either from the carer's or from the patient's point of view, is the leg rest, especially in mechanical patient chairs. These leg rests often consist of integrated foot and calf rests, an unwieldy separate component which is mountable on and dismountable from the patient chair by hinge mechanisms. In many cases, the construction is such that when transporting the patient chair, for instance in a narrow lift, or in a lavatory/bathroom, the leg rest (sometimes separate for left leg and right leg, sometimes one component for both feet) must be dismounted. Especially in mechanical patient chairs, they have only one use position, corresponding to a normal sitting position of an "average" patient, supporting one or both legs of the patient, causing stasis in other patients. They are often in the patient's way when he/she is to be seated in the patient chair or be moved from the patient chair by carers. They can also be in the way of patients who can walk fairly well and can sit down on their own in a normal chair, but must first be seated before the position of the legs is arranged. Any possibility of dismounting is merely occasionally used by carers, since dismounting and subsequent mounting is considered difficult and time consuming. When moving a patient from the patient chair, for instance from a wheelchair to a shower chair or from a shower chair to a bed, the patient's legs must be lifted separately by the carer if the patient himself is incapable of raising his legs, thus facilitating the movement of the patient. Lifting of legs is heavy work for the carers, especially in view of the fact that the carers must perform this operation in an ergonomically unsatisfactory position. The leg supports of some patient chairs fitted with electronics are electronically pivotable outwards and inwards, allowing the legs to be straightened out from the normal sitting position, but a construction controlled by electronics, of course, makes the manufacture of the patient chair expensive and does not allow easy dismounting and/or moving away of the leg support, which would be necessary, for instance, before entering a narrow lift, or when the patient is seated on a shower/toilet chair over a toilet/bedpan in which case a more upright sitting position is desirable.

OBJECTS OF THE INVENTION

An object of the present invention is to provide a calf rest construction for a patient chair, which is simple and thus can be manufactured at low cost. The calf rest construction may have an inactive position where it takes up a small space on the patient chair and thus need not be removed when moving the patient chair to narrow spaces, and may also have an active position supporting a patient's legs in a raised position. Another object of the present invention is that the calf rest construction should be detachable from the patient chair, if the option of detachment should be considered important.

SUMMARY OF THE INVENTION

In accordance with one embodiment, a calf rest is provided that includes a plate-shaped calf rest and a mounting which is mounted on the patient chair by means of an articulated joint arrangement. The joint arrangement may be designed so that the calf rest pad is movable between an inactive moved-away end position, in which the extent of the calf rest pad is essentially parallel to one of two sides of the patient chair and the calf rest pad is positioned close to the patient chair, and a second active end position, where the calf rest pad is capable of supporting the patient's legs when extended, outwards away from the patient chair.

BRIEF DESCRIPTION OF THE DRAWINGS

An embodiment of the invention will now be described in more detail with reference to the accompanying drawings.

DETAILED DESCRIPTION

Figure 1B:
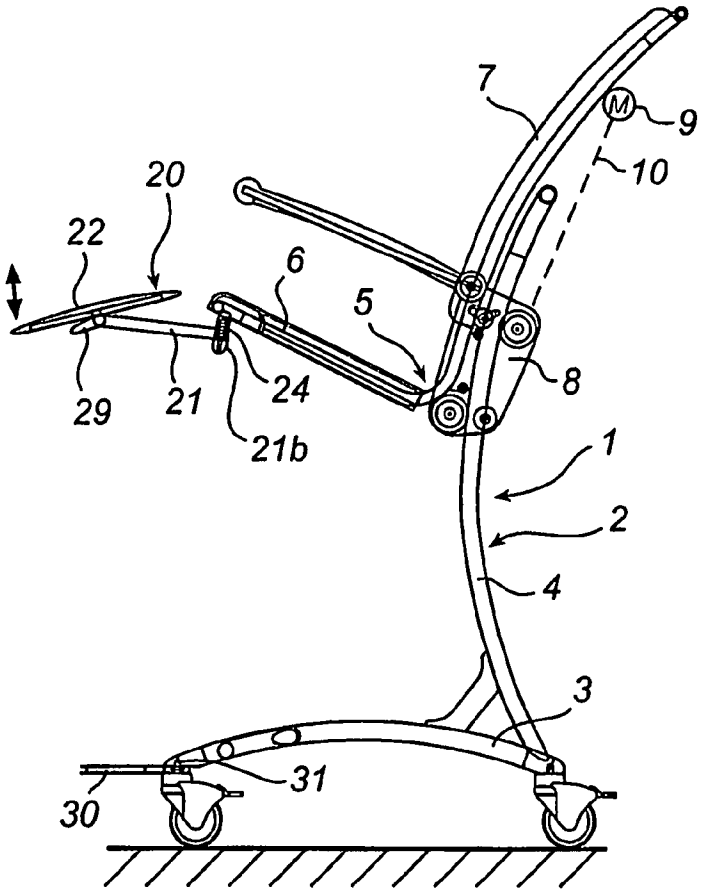
FIG. 1*b* illustrates the patient chair of FIG. 1 with the calf rest in an active position, consistent with an embodiment of the present invention.
Figure 1A:
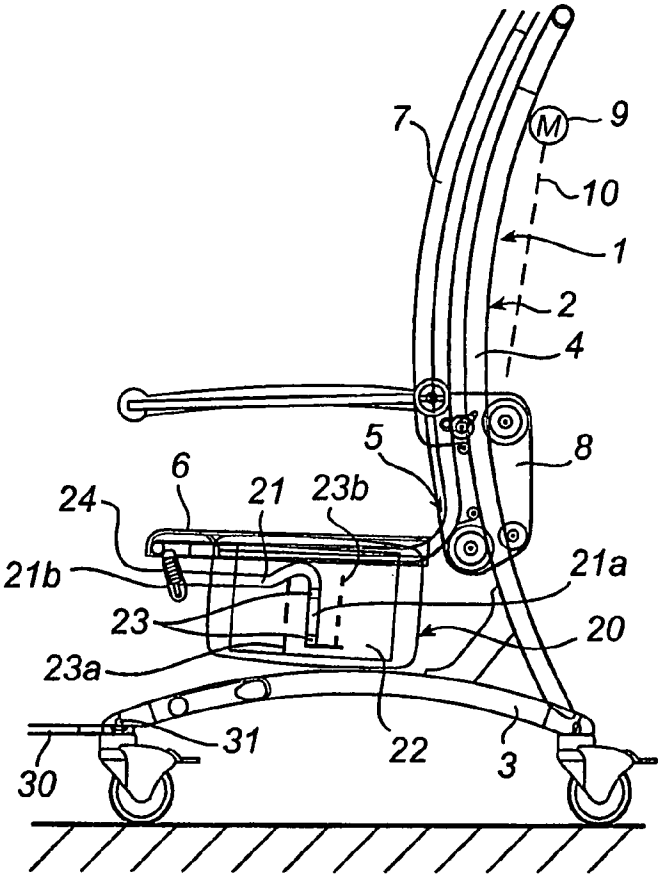
FIG. 1*a* illustrates an exemplary patient chair with a calf rest in an inactive position, consistent with an embodiment of the present invention.
Figure 1C:
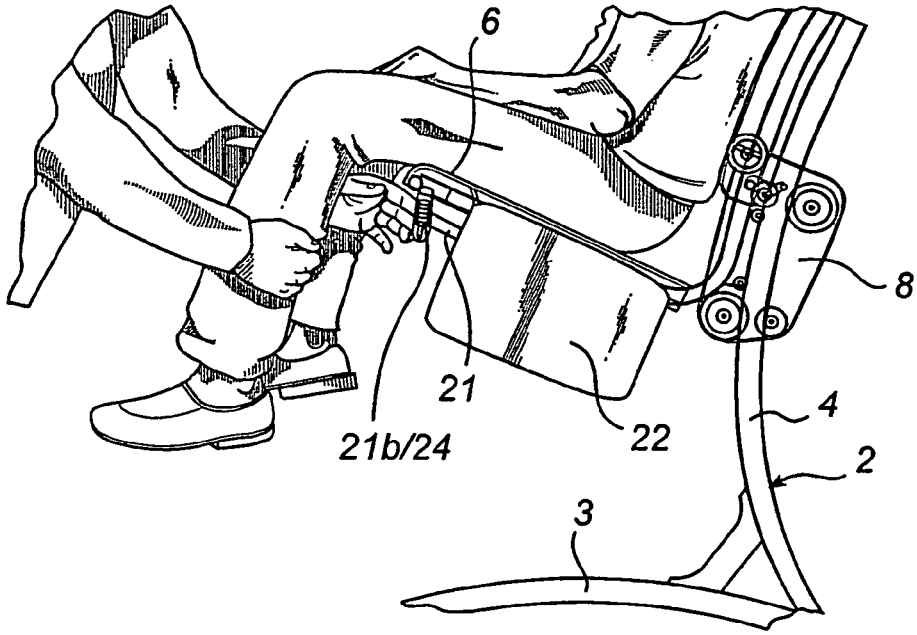
FIGS. 1*c-f* illustrate a sequence of movements of the calf rest between an inactive and an active position, consistent with an embodiment of the present invention.
Figure 1D:
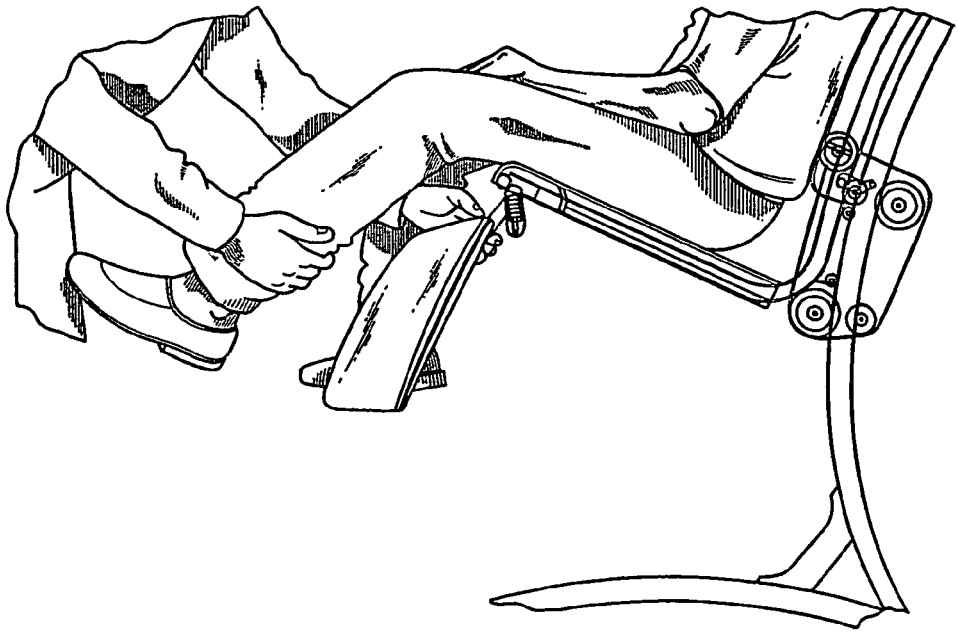
Figure 1E:
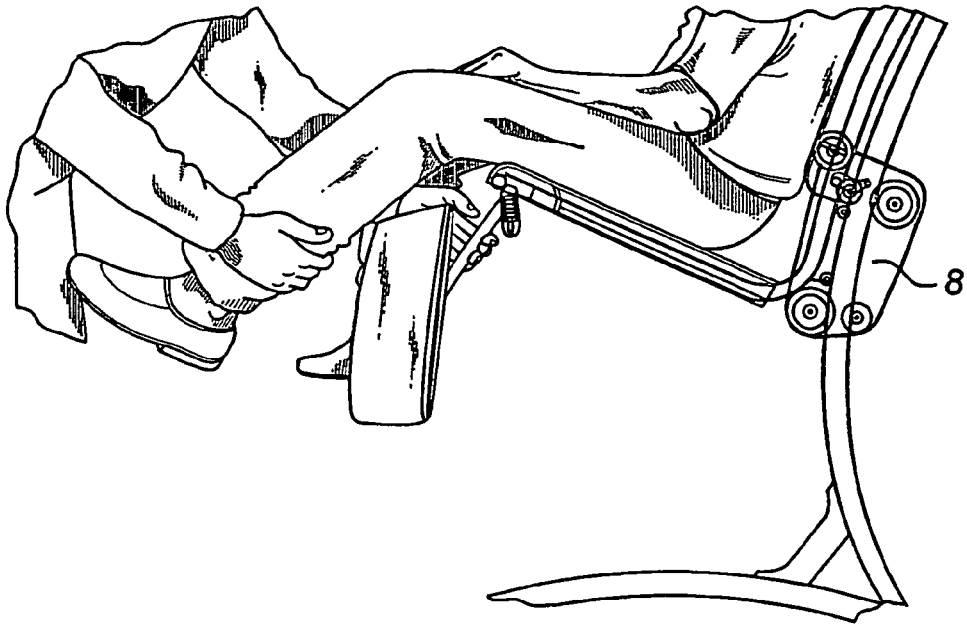
Figure 1F:
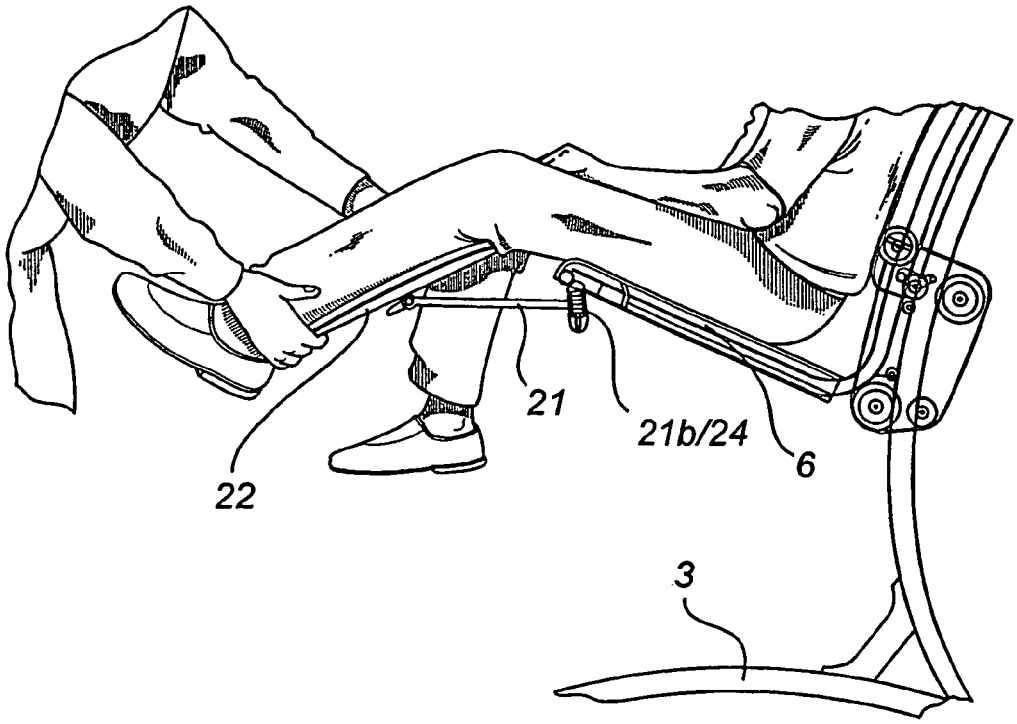

Reference is made to FIG. 1*a*, which illustrates part of a patient chair 1. The patient chair 1 may have a chassis 2, with a frame 3 and a substantially vertical, vertically arched stand 4. The stand 4 may be connected to a unit 5 of a seat and back 6, 7, by means of a roller bearing arrangement 8 which may be attached to the unit 5 and adapted to roll on the stand 4. Thus, the unit 5 may be movable on the stand 4, following the arc shape thereof. The movement can be effected in various ways, such as, for example, by using hand power acting on a winch, or by using an electric pneumatic motor, etc. acting between the chassis 2 and the unit 5. In FIGS. 1*a*, 1*b*, a motor 9 and a transmission 10 for the roller bearing arrangement 8 are shown.

A calf rest 20, according to an embodiment of the present invention, may be mounted on the patient chair 1. The calf rest 20 may comprise a mounting arm 21 and, mounted thereon, a plate-shaped calf rest pad 22. The mounting arm 21 may have a transverse part 21*a* at one end and a chair mounting sleeve 21*b* at the other end. The transverse part 21*a* may form a hinge pin which cooperates with hinge pin holding elements 23 on the back of the calf rest pad 22, so that the calf rest pad may be tiltable on the arm 21, as indicated by the double arrow in FIG. 1*b*.

The chair mounting sleeve 21*b* may be arranged for hinge engagement with a pin-like fastener 24, which may be fixed to the underside of the seat 6 close to the front edge thereof and close to a corner thereof.

In FIG. 1*a*, the calf rest 20 is in an inactive, non-calf-supporting, and moved-away end position. The moved-away position may be used, for instance, while a patient is made to sit in the patient chair 1 by carers, when transporting or storing the patient chair 1 without a patient, or when transporting a patient in narrow spaces.

In FIG. 1*b*, the calf rest is in an active position, which may be another end position of the calf rest 20, supporting an extended leg of a patient sitting in the patient chair 1.

As is evident from FIG. 1*a*, the extent of the calf rest pad 22 in the inactive position may be essentially parallel to the patient chair side, i.e. its major parts may be essentially parallel to the vertical and horizontal direction of the patient chair 1, and the calf rest pad 22 may be positioned quite close to the seat 6, with the mounting arm 21 extended between the seat 6 and the calf rest pad 22. Accordingly, in the inactive position, the calf rest 20 may take up a minimum space on the patient chair 1, seen in the transverse direction thereof.

The arrangement may be such that a movement between the active and inactive positions of the calf rest 20 may occur in a single part-circular sweeping motion of the calf rest 20 about the pin fastener 24, so that the calf rest 20, when approaching the patient's leg (extended vertically in the sifting position) during this sweeping motion (from the inactive position) enters, from the side of the patient's leg, under the leg which may now be lifted by the carer.

To perform such a sweeping motion, the pin fastener 24 on the seat 6 may be inclined at a suitable angle. This is evident from FIGS. 1*c-f*, which illustrate a sequence of movements of the calf rest components 21, 22 from the inactive position to the active position.

Figure 2:
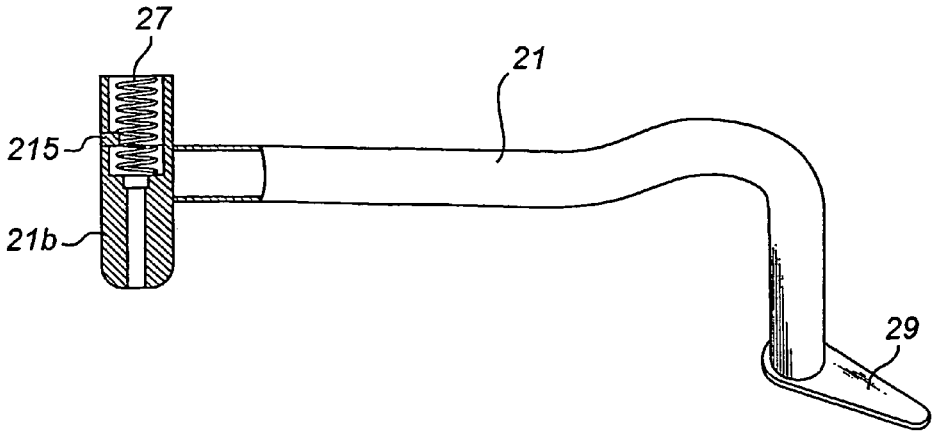
FIG. 2 illustrates an exemplary calf rest mounting arm partly in perspective, partly in cross-section, consistent with an embodiment of the present invention.

As is evident from FIGS. 1*b* and 2, the mounting sleeve 21*b* may have an internal lug 215. The lug 215 may cooperate, in the course of the motion, with a circumferentially extended guide groove 26 in the pin fastener 24. Blind pockets 25, 25', which may be substantially perpendicular to this guide groove 26, define the end positions of the calf rest 20. The pocket 25 may correspond to the inactive position, while the pocket 25' may correspond to the active position. In the mounting sleeve 21*b*, there may also be a pressure spring 27 to provide automatic insertion (snapping-in) of the lug 215 into the respective pockets 25 when reaching the end positions.

It should be noted that the inclination of the pin 24 and the sleeve 21*b* cooperating therewith may automatically result in assistance by gravity to move the calf rest 20 from the inactive end position to the active end position, implying that the carer need not apply power during the major part of the movement. With a suitable inclination of the hinge arrangement 21*b* and 24, which may be apparent to a person skilled in the art, the angle $\alpha$ can be about 150° and the angle $\beta$ can be about 60°. These angle values are provided for exemplary purposes and are not intended to be limiting; they depend on the length of the mounting arm 21, which may in turn be adjusted to the point on the present patient chair 1 at which the calf rest 20 can be mounted while taking different aspects into consideration.

Figure 3A:
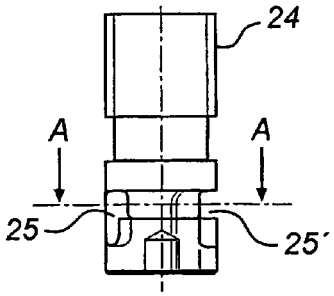
FIG. 3*a* is a perspective view of a an exemplary loose fastening pin which is fixed to the underside of the patient chair, consistent with an embodiment of the present invention.
Figure 3B:
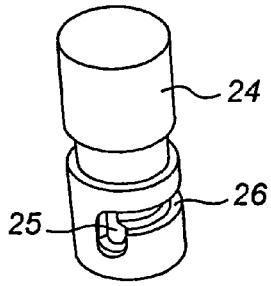
FIG. 3*b* is a side view of the exemplary fastening pin, consistent with an embodiment of the present invention.
Figure 3C:
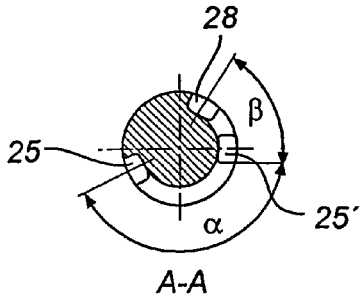
FIG. 3*c* is a cross-sectional view of the exemplary fastening pin, taken along line A-A in FIG. 3*a*, consistent with an embodiment of the present invention.
Figure 3D:
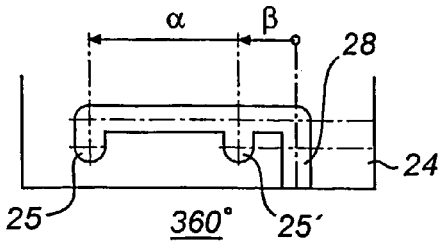
FIG. 3*d* illustrates an exemplary groove, shown in FIGS. 3*a-c*, in an extended state and on a larger scale, consistent with an embodiment of the present invention.

The calf rest 20 can be removed from its fastener 24 in the active position through a third pocket 28 which may be perpendicular to the guide groove 26, and which may open in the bottom surface of the fastener 24, see FIG. 3*d*.

As evident from that stated above, the calf rest 20 may be operated in the following way. With the calf rest 20 in the inactive position (FIG. 1*a*), the carer may press the sleeve 21*b* upwards, against the action of the spring 27, whereby the lug may be disengaged from the pocket 25, and can run in the guide groove 26 with a falling motion (see FIGS. 1*c*-1*f*), during which the carer can stop/slow down its movement while the patient's leg is only slightly lifted, so that the calf rest pad 22 can be pivoted inwards sideways behind (under) the patient's calf. In the vicinity of the active end position, the carer may help the mounting arm 21 and the calf rest pad 22 to enter (snap into, by means of the pressure spring 27) the end position in the pocket 25', as shown in FIGS. 1*c-f* and 1*b*. To perform a returning movement to the inactive position, the carer again presses the sleeve 21*b* upwards, whereby the mounting arm 21 and, thus, the calf rest pad 22, can be pivoted back to the inactive position. To remove the calf rest 20 from its pin fastener 21*b* and from the patient chair 1, the mounting arm 21 may be pivoted in the opposite direction, so that the lug 215 may be moved to the pocket 28 and can exit through the opening on the underside of the pin fastener 24.

It should be understood that a mirror-inverted calf rest 20 may be located on the other side (not shown) of the patient chair 1. However, it is possible for a mounting arm 21 to support two calf rest pads, for the patient's left leg and right leg. The above-mentioned saving of space in the lateral direction of the patient chair 1 may still be achieved.

The calf rest 20 may have, as shown in FIGS. 1*a*, 1*b* and 2, a rotatable ear 29 at the pad end of the mounting arm 21, which serves to lock the calf rest pad 22 in a suitable tilted position relative to the mounting arm 21, wherein a suitable position is selected according to the patient's needs (the leg may be more or less inclined).

For adjustment to different patients with differently long (lower) legs, the calf rest pad 22 can be provided with spaced-apart hinge holding elements, illustrated by dashed lines 23*a*, 23*b* in FIG. 1, for engagement with the transverse part 21*b* of the mounting arm 21.

FIGS. 1*a* and 1*b* also illustrate foot rests 30 which may be pivotable in their plane sideways, inwards under the seat 5 by means of a hinge 31. Preferably, the foot rests 30 may be separated from the calf rest 20, for as much free space as possible to be available under the seat 5.

A patient chair with a vertically adjustable seat has been described above. The calf rest 20, according to an embodiment of the present invention, may have the special advantage precisely in such patient chairs, in that in a raised position of the patient, the carer may not be required to bend to operate the calf rest 20, thus avoiding straining of the carer's back.

However, the calf rest 20 according to an embodiment of the present invention may be usable also for patient chairs that do not have a vertically adjustable seat. The calf rest 20 may still have its important advantage of adjustability in a position requiring a small space close to the patient chair. It should be understood that the calf rest 20 need not be fixed to the seat, but can be fixed to any other suitable part of the chassis.

An alternative construction of the calf rest 20 according to the invention may be designed similar to an aircraft table in the front row, where a hinge may allow raising of one (rear) edge end of the table leaf, arranged with its major parts in a vertical position, about a hinge at the front edge end. After that, lowering of the table leaf to a horizontal position may be accomplished by another hinge.

The invention claimed is:

1. A calf rest for a patient chair with a chair front, a chair back, a chair seat extending generally across a sitting plane, and two chair sides, the calf rest comprising a plate-shaped calf rest pad and amounting which is mounted on the patient chair by means of an articulated joint arrangement, wherein a. the joint arrangement is designed so that the calf rest pad is movable between an inactive moved-away end position, wherein the extent of the calf rest pad is essentially parallel to one of the two sides of the patient chair and is positioned close to the patient chair, and a second active end position, wherein the calf rest pad is capable of supporting the patient's legs when extended, outwards, away from the patient chair, and b. the joint arrangement rotates about a rotational axis aligned at an acute angle with respect to a perpendicular to the sitting plane, c. the joint arrangement includes a mounting arm which:

(1) extends from the rotational axis in a direction oriented at least substantially parallel to the sitting plane when the calf rest pad is in the inactive moved-away end position, (2) includes a transverse arm extending therefrom whereupon the calf rest pad is affixed, wherein the transverse arm extends from the mounting arm:

i. in a direction oriented at least substantially perpendicular to the sitting plane when the calf rest pad is in the inactive moved-away end position, and ii. in a direction oriented at least substantially parallel to the sitting plane when the calf rest pad is in the active end position.

2. A calf rest according to claim 1, wherein the joint arrangement is also designed so that the movement of the calf rest from the inactive end position to the active end position is a part-circular sweeping motion from above, downwards, and upwards, relative to the patient chair, so that the calf rest pad approaches a leg of a patient in the chair essentially from behind.

3. A calf rest according to claim 1, wherein the mounting comprises an arm, one end of which is suspended from the patient chair by means of the joint arrangement.

4. A calf rest according to claims 3, wherein the joint arrangement is positioned on the underside of the chair seat.

5. A calf rest according to claim 4, wherein the joint arrangement is positioned close to the front edge of the underside, close to a corner of the chair seat.

6. A calf rest according to claim 1, wherein the joint arrangement is a hinge arrangement, consisting of a single hinge.

7. A calf rest according to claim 1, wherein the calf rest pad is articulated to the calf rest, so that the calf rest pad is tiltable on the mounting.

8. A calf rest according to claim 1, wherein the calf rest has a plurality of mounting points for the calf rest pad, for adaptation to patients with different lengths.

9. The calf rest of claim 1 wherein the rotational axis is aligned at an acute angle with respect to planes perpendicular to the sitting plane and extending from the chair seat:

a. along the chair front, and b. along the chair sides.

10. The calf rest of claim 1 wherein:

a. the transverse arm is rigidly affixed to the mounting arm;

b. a plane defined by the transverse arm and the mounting arm is oriented:

(1) in a direction oriented at least substantially perpendicular to the sitting plane and parallel to a chair side when the calf rest pad is in the inactive moved-away end position, and (2) at least partially upwardly and forwardly when the calf rest pad is in the active end position.

11. The calf rest of claim 1 wherein:

a. the calf rest pad is rotatably affixed to the transverse arm, and b. the transverse arm bears a stop thereon, the stop limiting the extent of rotation of the calf rest pad with respect to the transverse arm.

12. The calf rest of claim 1 wherein the rotational axis is aligned at an acute angle with respect to planes perpendicular to the sitting plane and extending from the chair seat:

a. along the chair front, and b. along the chair sides.

13. A calf rest for a patient chair with a chair front, a chair back, a chair seat extending generally across a sitting plane, and two chair sides, the calf rest comprising a plate-shaped calf rest pad and a mounting which is mounted on the patient chair by means of an articulated joint arrangement, wherein:

a. the joint arrangement is designed so that the calf rest pad is movable between an inactive moved-away end position, wherein the extent of the calf rest pad is essentially parallel to one of the two sides of the patient chair and is positioned close to the patient chair, and a second active end position, wherein the calf rest pad is capable of supporting the patient's legs when extended, outwards, away from the patient chair, b. the joint arrangement rotates about a rotational axis aligned at an acute angle with respect to a perpendicular to the sitting plane, c. the joint arrangement bears a sleeve which rotates about the rotational axis, the sleeve having an inwardly-extending lug, wherein the lug rides within a slot oriented in a circumferential direction about the rotational axis, the slot having a pocket extending therefrom in an axial direction with respect to the rotational axis, d. the joint arrangement may rotate about the rotational axis with the lug riding in the slot, and e. the joint arrangement may be locked against rotation about the rotational axis with the lug situated in the pocket.

14. The calf rest of claim 13 wherein the joint arrangement is biased by an elastic member to urge the lug into the pocket when the lug is aligned in the slot adjacent the pocket.

15. A calf rest for a patient chair with a chair front, a chair back, a chair seat extending generally across a sitting plane, and two chair sides, the calf rest comprising a plate-shaped calf rest pad and a mounting which is mounted on the patient chair by means of an articulated joint arrangement, wherein a. the joint arrangement is designed so that the calf rest pad is movable between an inactive moved-away end position, wherein the extent of the calf rest pad is essentially parallel to one of the two sides of the patient chair and is positioned close to the patient chair, and a second active end position, wherein the calf rest pad is capable of supporting the patient's legs when extended, outwards, away from the patient chair, b. the joint arrangement rotates about a rotational axis aligned at an acute angle with respect to a perpendicular to the sitting plane, wherein the rotational axis is defined by a pin extending downwardly from the sitting plane to terminate in a free end, b. the joint arrangement bears a sleeve which rotates about the pin, wherein:

(1) a lug extends between the pin and sleeve, the lug riding within a slot oriented in a circumferential direction about the rotational axis, whereby the joint arrangement may rotate about the rotational axis with the lug riding in the slot, and (2) the slot bears a channel extending therefrom in an axial direction with respect to the rotational axis, wherein the sleeve may be removed from the pin by aligning the lug within the channel and sliding it therefrom.

16. A calf rest for a patient chair having a chair front, a chair back, a chair seat extending generally across a sitting plane between the chair front and chair back, and a pair of chair sides laterally situated an opposing sides of the chair seat and extending between the chair front and chair back, wherein the calf rest includes:

a. a calf rest pad having a pad upper surface, wherein the calf rest pad is movable between:

(1) a stowed position situated alongside a chair side, wherein the pad upper surface faces at least partially laterally;

(2) an in-use position situated forwardly of the chair front, wherein the pad upper surface faces at least partially forwardly and at least partially upwardly;

b. a mounting arm having:

(1) a first end rotatable about a rotational axis angled off of a perpendicular to the sitting plane, and (2) a second end bearing a transverse arm extending therefrom upon which the calf rest pad is mounted, the transverse arm extending in a direction oriented:

i. at least substantially perpendicular to the sitting plane when the calf rest pad is in the stowed position, and ii. at least substantially parallel to the sitting plane when the calf rest pad is in the in-use position.

17. The calf rest of claim 16 wherein the pad upper surface is oriented at least substantially perpendicular to the sitting plane and at least substantially parallel to a chair side when the calf rest pad is in the stowed position.

18. The calf rest of claim 16 wherein the transverse arm is rigidly affixed to the mounting arm.

19. A calf rest for a patient chair having a chair front, a chair back, a chair seat extending generally across a sitting plane between the chair front and chair back, and a pair of chair sides laterally situated on opposing sides of the chair seat and extending between the chair front and chair back, wherein the calf rest includes:

a. a mounting arm having an end rotatable about a pivot adjacent the chair seat, b. a transverse arm rigidly affixed to, and extending at an angle from, the mounting arm, and c. a calf rest pad situated on the transverse arm, the calf rest pad having a pad upper surface;

wherein the mounting arm is rotatable about the pivot between:

(1) a stowed position wherein:

i. the mounting arm extends adjacent, and at least substantially parallel to, a chair side;

ii. the transverse arm is oriented at least substantially perpendicular to the sitting plane, and iii. a plane defined by the mounting arm and transverse arm faces at least partially laterally; and (2) an in-use position wherein:

i. the mounting arm extends forwardly of the chair front, ii. the transverse arm is oriented at least substantially parallel to the sitting plane, and iii. a plane defined by the mounting arm and transverse arm faces at least partially upwardly and forwardly.

20. The calf rest of claim 19 wherein the mounting arm rotates about a rotational axis angled off of a perpendicular to the sitting plane.

21. The calf rest of claim 19 the calf rest pad is pivotable about the transverse arm.

22. The calf rest of claim 19 the pad upper surface faces:

a. at least partially laterally when the mounting arm is in the stowed position, and b. at least partially upwardly and forwardly when the mounting arm is in the stowed position.

* * * * *